United States Patent [19]

Jorgensen

[11] Patent Number: 4,643,103

[45] Date of Patent: Feb. 17, 1987

[54] COLLAPSIBLE TABLE

[76] Inventor: Robert A. Jorgensen, P.O. Box 64, Leavenworth, Wash. 98826

[21] Appl. No.: 715,673

[22] Filed: Mar. 25, 1985

[51] Int. Cl.[4] ..... A47B 3/091

[52] U.S. Cl. ..... 108/36; 108/128; 108/132

[58] Field of Search ..... 108/36, 35, 132, 128; 248/434

[56] References Cited

U.S. PATENT DOCUMENTS

| | | | |
|---|---|---|---|
| 1,062,996 | 5/1913 | Sornberger | 108/36 |
| 1,178,597 | 4/1916 | Owens | 108/128 X |
| 1,272,560 | 7/1918 | Stone | 108/35 |
| 1,378,178 | 5/1921 | Korn | 108/35 |
| 1,585,569 | 5/1926 | Stine | 108/36 |
| 1,762,580 | 6/1930 | Menk | 108/36 X |
| 1,838,095 | 12/1931 | Fanarjian | 108/36 X |
| 2,015,560 | 9/1935 | Iafrate | 108/128 |
| 2,324,684 | 7/1943 | Dietz | 190/12 R |
| 2,747,956 | 5/1956 | Leichter | 108/36 |
| 2,759,576 | 8/1956 | Townsend | 108/34 X |
| 3,214,217 | 10/1965 | Jente | 108/128 X |
| 3,279,399 | 10/1966 | White | 108/38 |
| 3,641,947 | 2/1972 | Finney | 108/38 |
| 3,989,295 | 11/1976 | Sparkes | 297/39 |

FOREIGN PATENT DOCUMENTS

| | | | |
|---|---|---|---|
| 2029034 | 12/1971 | Fed. Rep. of Germany | 108/35 |
| 342574 | 9/1904 | France | 108/35 |

*Primary Examiner*—Kenneth J. Dorner
*Assistant Examiner*—José V. Chen
*Attorney, Agent, or Firm*—Eugene D. Farley

[57] ABSTRACT

A collapsible table, particularly a book-simulating collapsible table, comprises a central support component having hinged to its opposite sides a pair of leaves which in their extended position form a table top and in their collapsed condition form a container, for example a container of small compass resembling a book in its external appearance. A plurality of legs is pivotally connected to the support member. In the collapsed condition of the leaves, the legs are contained in collapsed condition within the container. In the extended, or table top, condition of the leaves, the legs are extended to perform their usual support function.

4 Claims, 18 Drawing Figures

COLLAPSIBLE TABLE

BACKGROUND AND GENERAL STATEMENT OF THE INVENTION

This invention pertains to collapsible tables. It pertains particularly to book-simulating collapsible tables.

In order to be disguisable as a book which may be stored inconspicuously in a pile of real books, or upon bookshelves, a collapsible table must meet rigid specifications which are difficult of attainment.

In its collapsed condition, it must be no larger than a medium size book. However, in its expanded, use condition it must have normal table height of about 19½ inches and a useful table top size, for example 12 inches by 22¼ inches. It also should have a weight not exceeding two or three pounds.

It is the general purpose of the present invention to provide a book-simulating collapsible table which in its collapsed condition resembles a book and is compatible with other books with which it is stored, but which in its extended, use position provides a full scale occasional table useful for many purposes, i.e. as an occasional table for T.V. entertaining, as a card table, as a table for use in camping, in playing chess, checkers or other games, etc.

It is a further purpose of the present invention to provide a book-simulating collapsible table which is easy to open and close; which does not require the addition of separate parts to be assembled with each use (i.e. it is complete in itself); which in use is stable and sturdy; which has an interior space for game storage, such as chess pieces, tableware etc.; which may be provided with interchangeable covers as desirable or necessary to conform to surrounding decor; and which may be opened or shut, with a simple, swift movement of the hands without the necessity of employing any extraneous instrument.

The foregoing and other objects of the present invention are accomplished by the provision of a collapsible table comprising a structural member having a top component and a support component extending outwardly substantially normal thereto. A pair of leaves is hinged to opposite sides of the top of the structural component, the leaves being foldable selectively between a co-planar, open position wherein they form a table top and a closed position wherein they form a container, preferably one simulating the covers of a book.

Collapsible mounting means pivotally mount a plurality of legs to the support component and the leaves. The collapsible mounting means and legs are dimensioned when in their collapsed condition for containment in the container, preferably with room to spare for the storage of tableware, game pieces and the like. Thus in one mode, the herein described device resembles a book which may be stored on bookshelves or on a table with other books. In its easily achievable other mode, it provides a sturdy occasional table having many applications.

THE DRAWINGS

Figure 6:
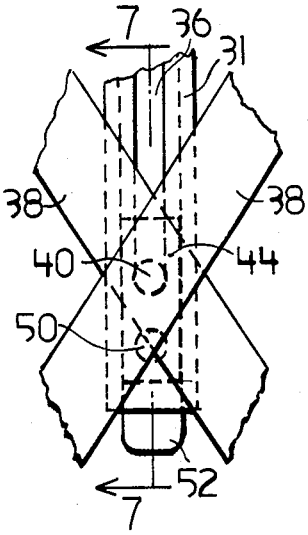
Figure 7:
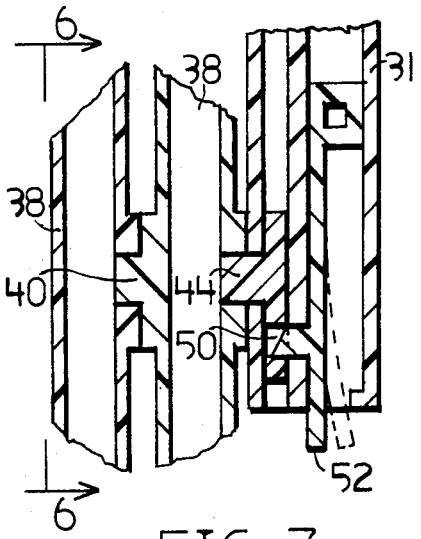
Figure 6A:
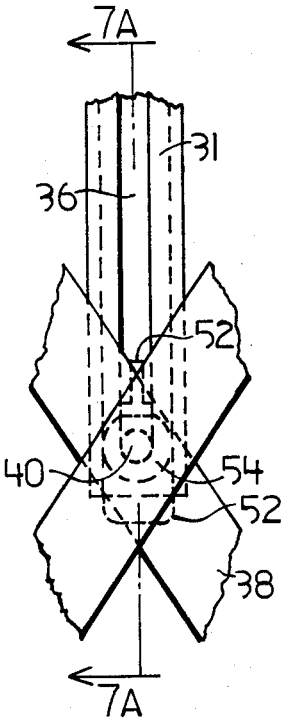
Figure 7A:
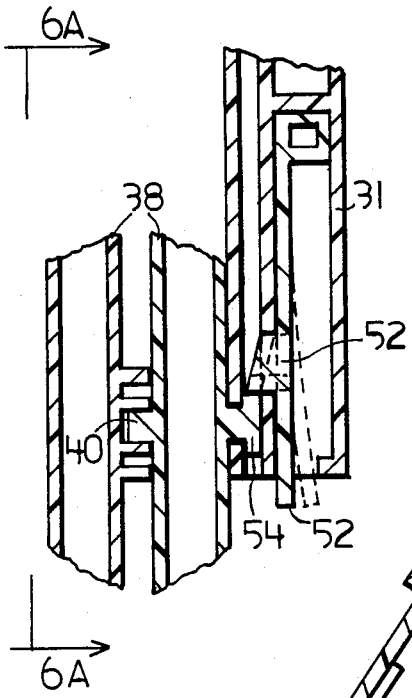
Figure 8:
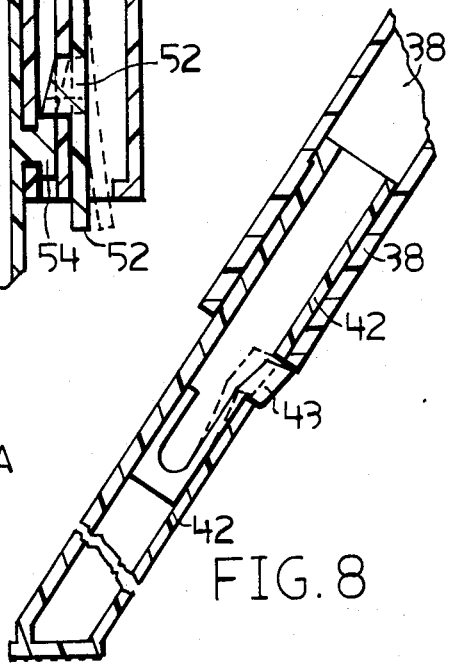
Figure 9:
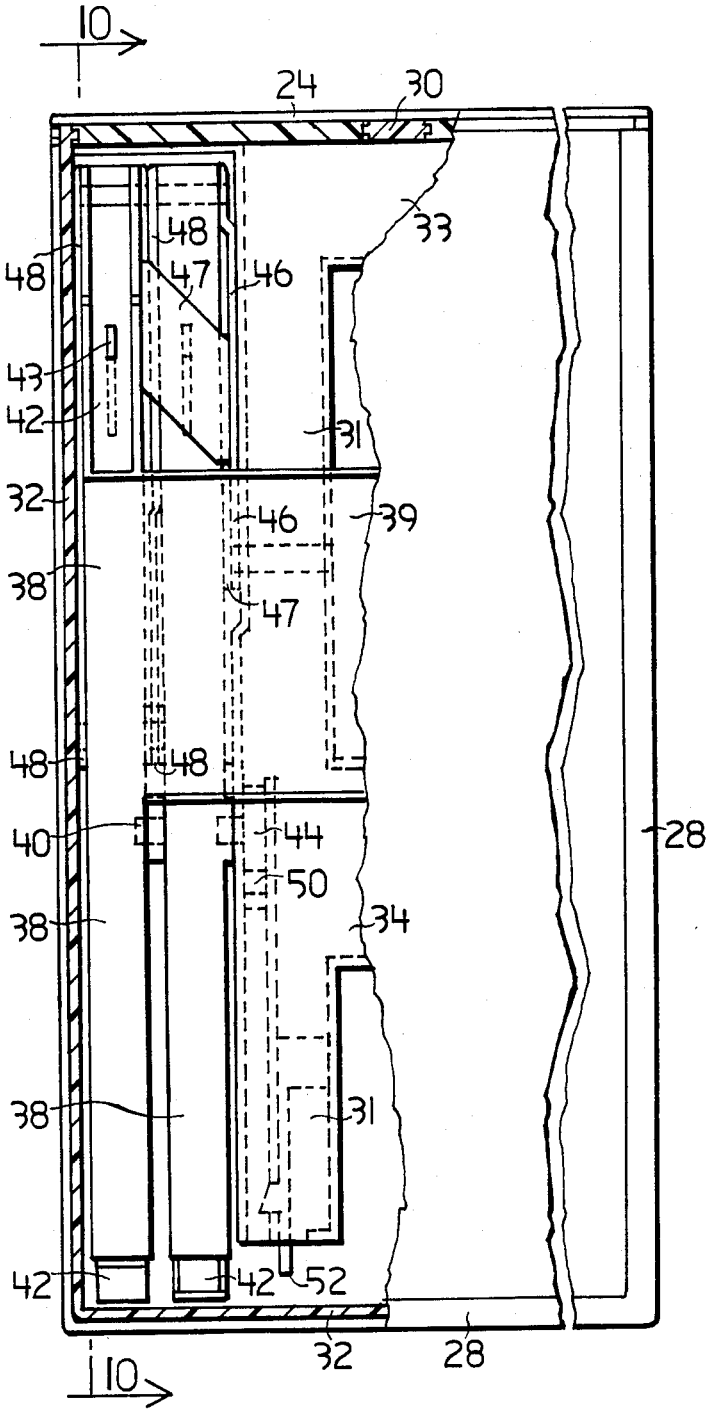
Figure 10:
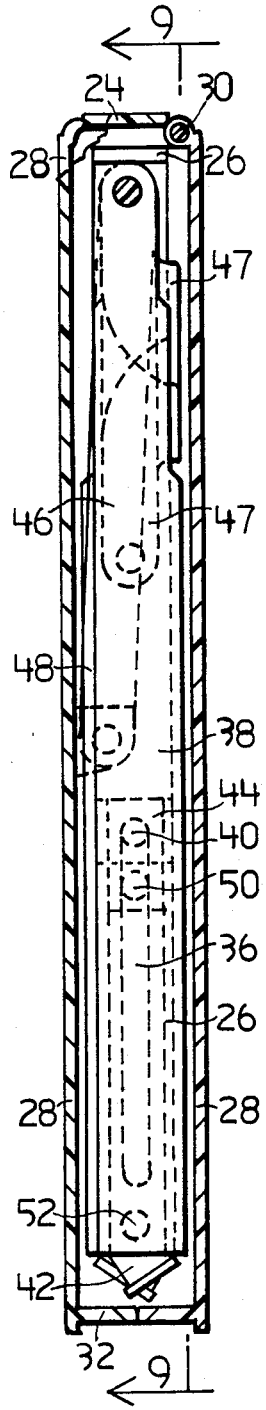
Figure 15:
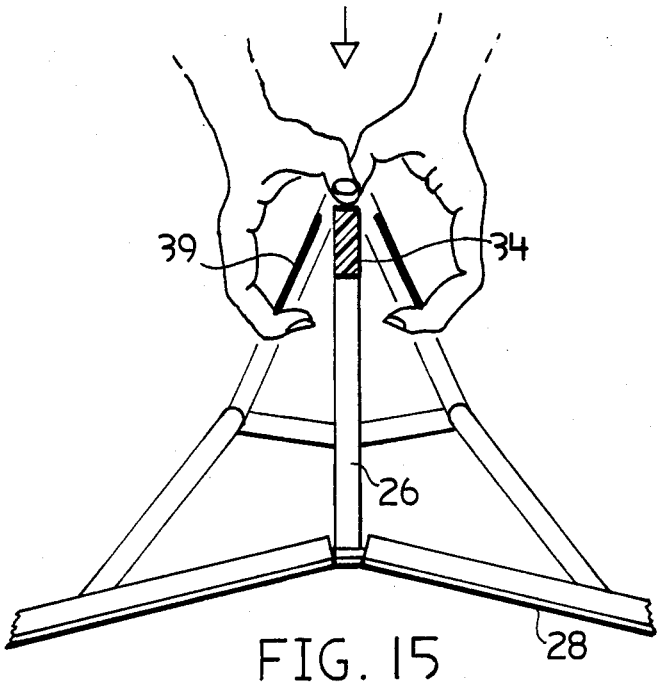
Figure 16:
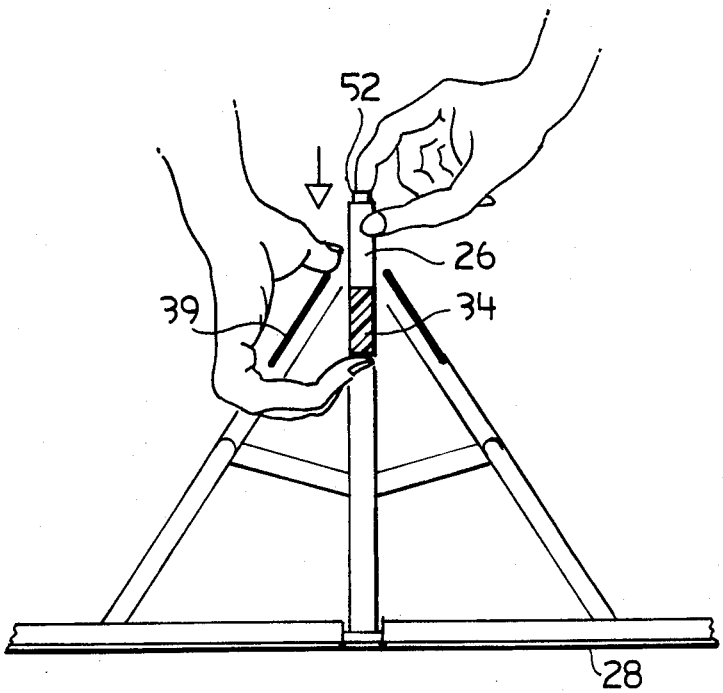

FIGS. 6, 7 and 8 are detailed, fragmentary, elevational views illustrating the construction and mode of operation of functional components of the collapsible table assembly, FIGS. 6 and 7 being illustrations in side elevation and transverse section, respectively, of the slide and guide assembly employed in operating the leaves and legs of the table and FIG. 8 being a fragmentary elevation illustrating the manner of extension of the legs of the table assembly;

FIGS. 6*a* and 7*a* are views corresponding to FIGS. 6 and 7 but showing an alternate construction for the slide and guide assembly;

FIGS. 9 and 10 are views in plan and elevation, respectively, illustrating the arrangement of the table parts when the assembly is in its collapsed, book-simulating mode;

FIGS. 11–14 are schematic views illustrating the mechanical sequence occurring when the table is adjusted from its collapsed, storage mode (FIG. 11) to its fully extended, use mode (FIG. 14); and FIGS. 15 and 16 are schematic views illustrating the simple manipulations required to achieve the erection of the table (FIG. 15) and the collapsing of the table (FIG. 16).

DESCRIPTION OF SPECIFIC EMBODIMENTS OF THE INVENTION

The components of the collapsible table of my invention may be fabricated from any suitable structural material. Preferably, for reasons of economy, ease of assembly, and strength, they are fabricated from extruded or molded plastic. However, they also may be fabricated from such materials as extruded aluminum, or from wood, if a cottage industry is contemplated.

Figure 1:
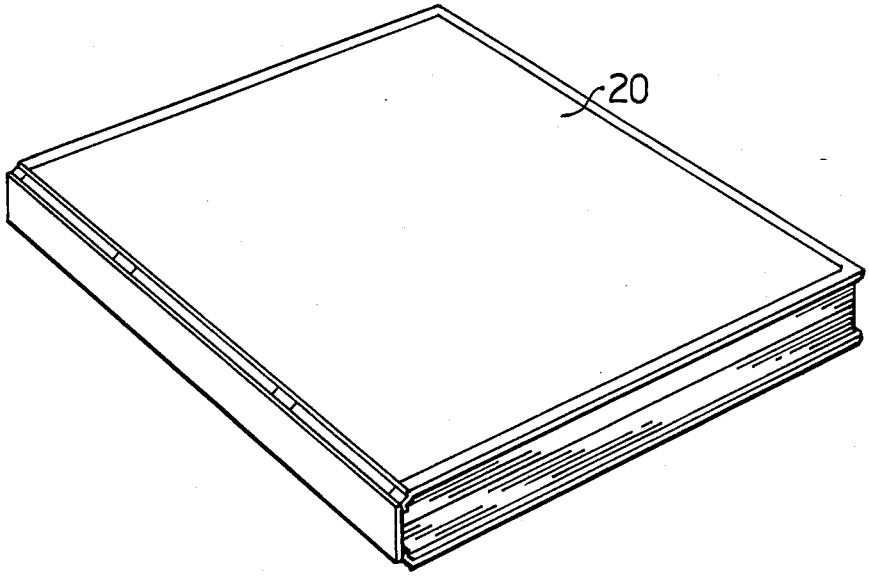
FIG. 1 is a perspective view of the book-simulating collapsible table of the invention in its collapsed, book-simulating mode.
Figure 2:
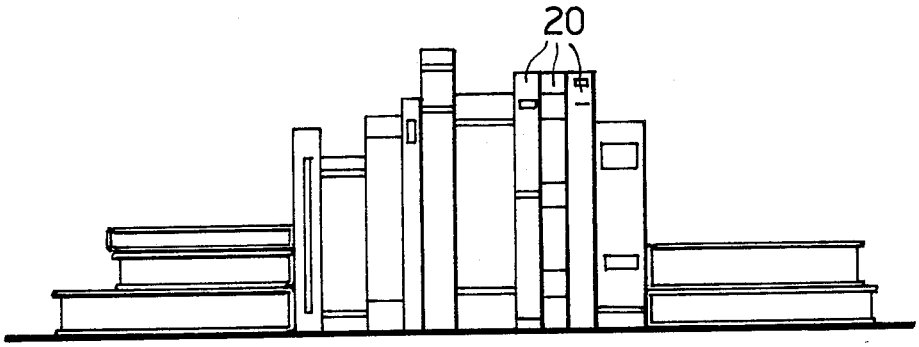
FIG. 2 is a schematic view in elevation illustrating the storage adaptability of the collapsible table of my invention, when in its collapsed condition.
Figure 3:
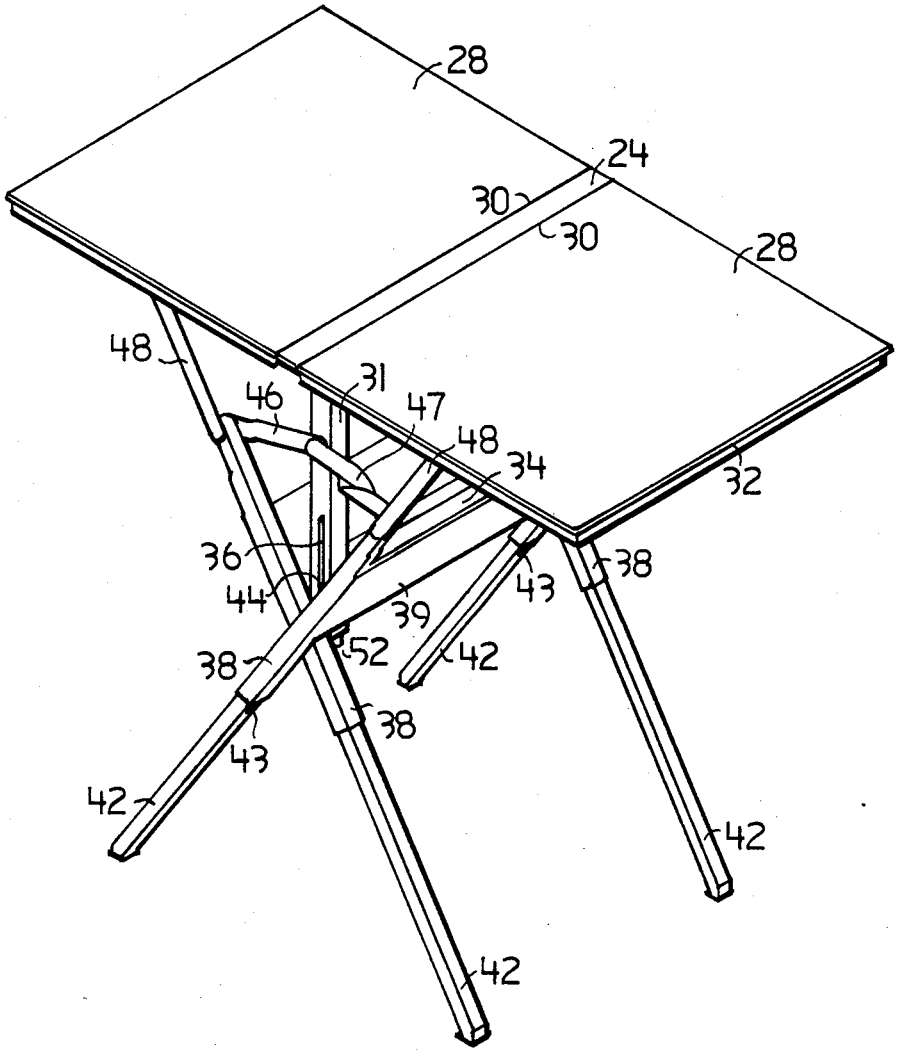
FIG. 3 is a top perspective view of the collapsible table of my invention in its extended, use mode.
Figure 4:
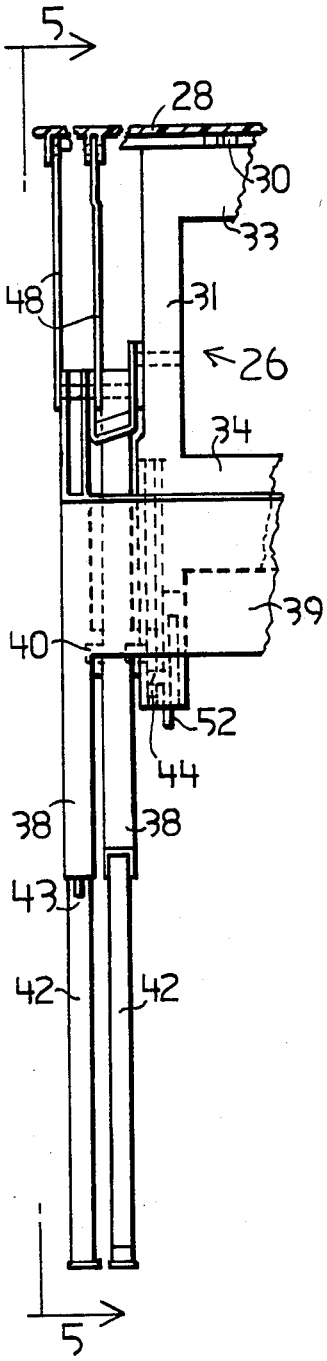
FIG. 4 is a fragmentary view of the table in side elevation.
Figure 5:
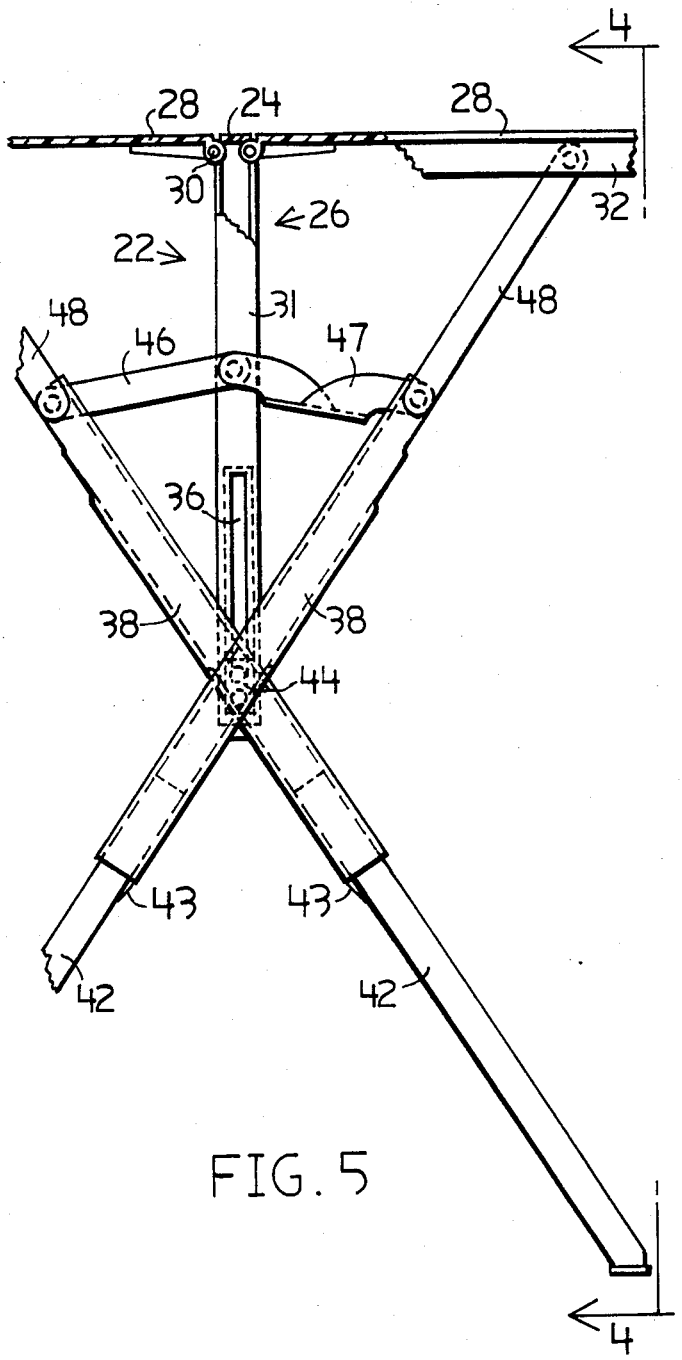
FIG. 5 is a fragmentary view of the table in end elevation.

Referring to FIGS. 3, 4 and 5, the collapsible table of my invention (in collapsed form, "book" 20 of FIGS. 1 and 2) is supported on a central support structure indicated generally at 22. The support structure includes a top component 24 which corresponds to the "spine" of a book. It also includes a lower or frame component 26 fixed to its underside and extending substantially normal thereto. This entire support assembly is referred to herein as a "spine" because of its position and its analogy to the spine of a book, which the herein described collapsible table is designed to represent.

A pair of leaves 28 is hinged to opposite sides of the top component 24 of the spine by means of hinges 30. Leaves 28 are provided on three sides with a downwardly extending flange or skirt 32 to simulate the body portion of a book when the assembly is in its collapsed mode.

Frame or support component 26 may be generally rectangular in plan and may comprise a pair of spaced, parallel, vertical posts 31 interconnected by a pair of spaced, horizontally arranged braces 33, 34.

The posts preferably are channel-shaped in cross section. On their outer surfaces they are formed with a pair of longitudinally extending slots which serve as guideways for a purpose which will appear hereinafter.

Further included in the collapsible table assembly are a plurality of legs which preferably comprise crossed, scissor-type, leg pairs 38 interconnected by gusset plates 39. Each leg pair is pivotally interconnected at its central crossing point by means of a pin 40. Both leg pairs 38 may comprise two crossed, H-shaped members made from a single piece of molded plastic and each comprising a pair of legs interconnected and spaced apart by a gusset plate 39.

Legs 38 are provided with extensions 42 which telescope into their component channels and are secured releasably in their extended position by suitable fasteners, for example umbrella type fasteners 43.

Cooperating with guideways 36 are slides, which in the illustrated form of the invention comprises pinned blocks 44.

Collapsible mounting means pivotally mount the legs 38 to the support component 26 of the spine and to the leaves 28.

As illustrated, the collapsible mounting means comprise a first pair of links 46, 47 interconnecting the upper portions of the legs and posts 31, centrally thereof. Link 47 is offset to accomodate the adjacent leg in the folded condition of the table.

The collapsible mounting means further includes a second pair of links 48 pivotally interconnecting the upper portions of the legs and the leaves 28 centrally thereof. It is to be noted that links 46 form with the post side members of frame member 26 two force triangles having a common side. This is important to the operation of the table.

Latch means is provided for latching the table in its opened out, extended position of FIG. 3.

In the illustrated embodiment, FIG. 7, the latch means comprise a female latch component 50 on slide 44, and a spring male latch member 52 mounted within the adjacent channel shaped post 31 of frame 26.

In the alternative embodiment of FIG. 6*a* and 7*a*, pinned block slide 44 is replaced by headed integral pin 54.

In other words, the central, vertical, support component 26 for the leaves 28 is the common side of a pair of back to back, inverted right triangles (FIG. 5) wherein the bases of the triangles make the table top line and the hypotenuses of the triangles make the scissor type leg line.

The leg lines, composed of legs 38 and pivotally connected links 48, extend cantilever-fashion outwardly from the hypotenuse line of the triangle. Additionally, they are breakable pivotally at a location central of the respective hypotenuses of the triangles.

Restraining and guiding pivotable links 46, 47 are connected centrally to the central vertical support 26 and to the legs 38, 48 at their breakable, pivotal location. Locking means 50, 52, located at the apexes of the triangles, releasably interlock the vertical support and the legs when the assembly is in its extended, use condition.

OPERATION

The operation of the book-simulating collapsible table of my invention is illustrated schematically in FIGS. 11–16.

Figure 11:
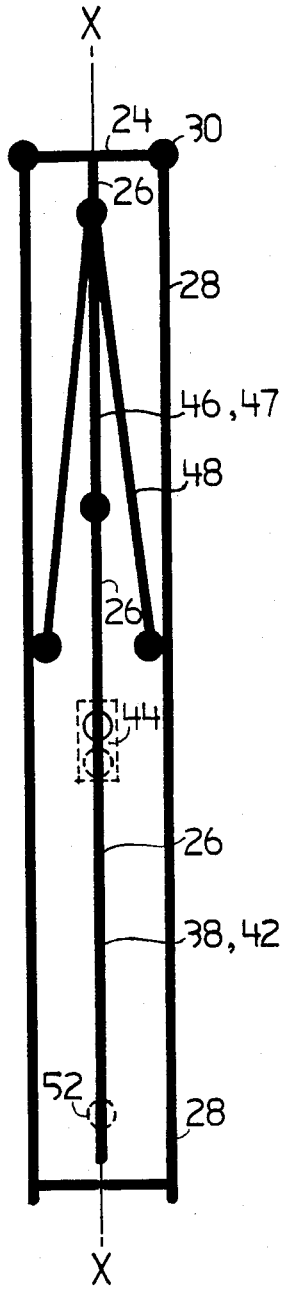
Figure 12:
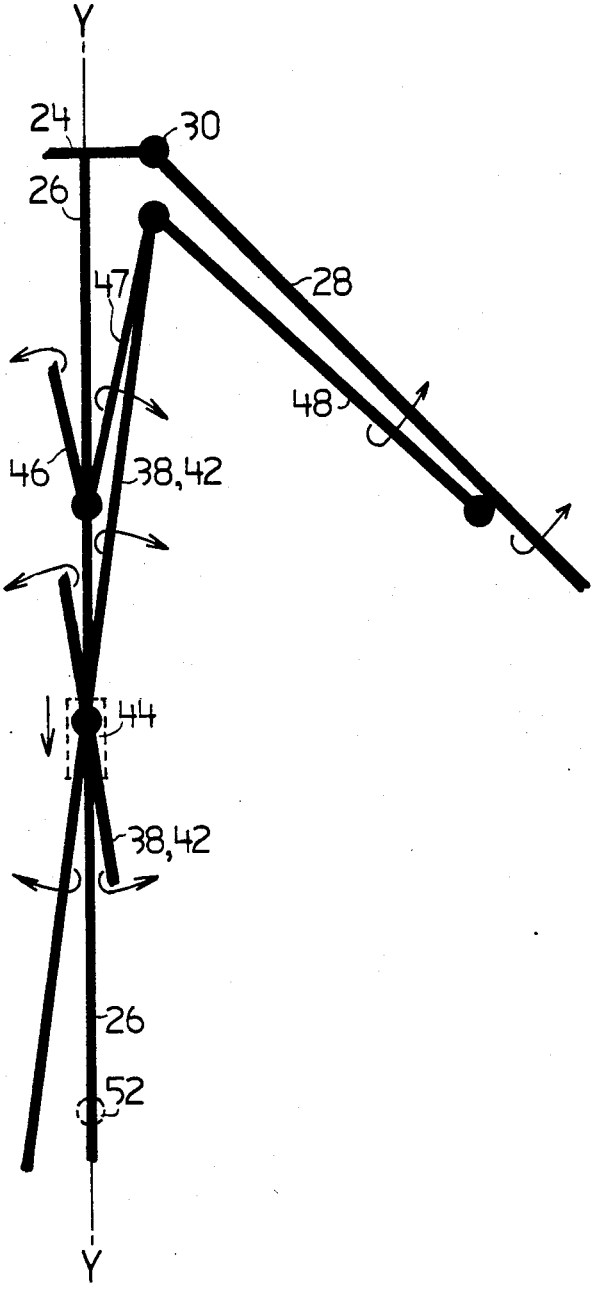
Figure 13:
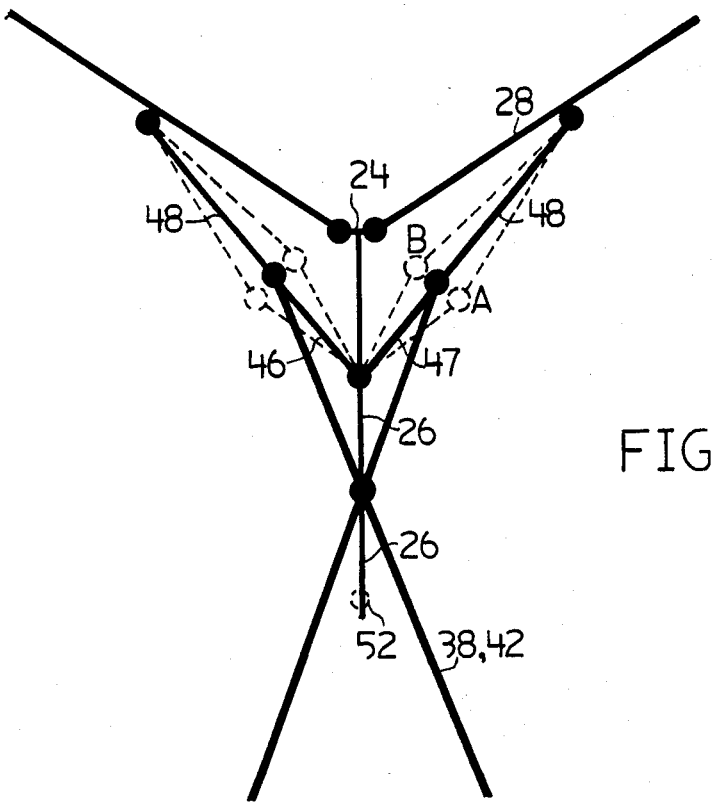
Figure 14:
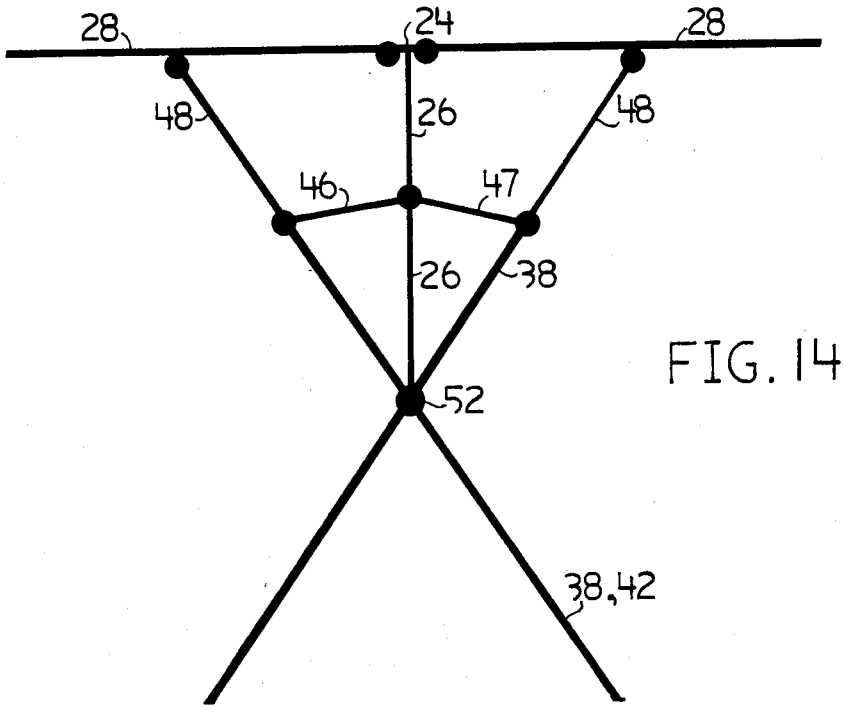

In the collapsed mode, i.e. the book mode, the assembly has the collapsed parts arrangement illustrated in FIG. 11. When the assembly is opened, the leaves 28 swing outwardly as illustrated by the arrows of FIG. 12. This movement continues through the past center position of FIG. 13. It is to be noted that, during the opening movement, the joint between links 48 and legs 38 moves from the full line position to the dashed line A position of FIG. 13.

Leaves 28 then move downwardly into coplanar position with each other and with spine top component 24. Latch 52 latches and the assembly is locked in its use position as a table, illustrated in FIG. 14.

When the table is collapsed into the book mode, the above-related movement of parts is reversed, links 48 and legs 38 moving from their full line intermediate position to their dashed line B position.

Easily performed manipulations for opening and closing the assembly are illustrated in FIGS. 15 and 16. To open the assembly, place it in the legs up position. Hook the fingers under gusset plates 39 and place the thumb on the outer edge of frame brace component 34. Lift the assembly into mid air and push down with the thumbs until both leg latches 52 click. Pull out the extendable legs and the table is ready for use.

To close the assembly, FIG. 16, turn the table legs up and telescope the legs. Place the fingers of one hand under the inner edge of brace plate 34 and push down slightly on gusset plate 39 with the thumb. Lift the assembly in mid air so the top is free to fold backwards.

With the other hand, release latches 52 whereupon the folding action is initiated gravitationally. It is completed by transferring the grip to the leaves and closing the assembly.

The objectives of the invention thus are achieved in the provision of a collapsible table, the components of which may be collapsed into very small compass such as is characteristic of a book of medium size. The performance specifications of a typical assembly may be approximately as follows:

Book Size, $1\frac{1}{8}$ inch $\times$ $10\frac{1}{2}$ inch $\times$ 12 inch.
Table Height, $19\frac{1}{2}$ inches.
Table Top Size, 12 inches by $22\frac{1}{4}$ inches.
Material, Molded Plastic.
Weight Limit, $2\frac{1}{2}$ lbs maximum.

Having thus described in detail preferred embodiments of the present invention, it will be apparent to those skilled in the art that many physical changes could be made in the apparatus without altering the inventive concepts and principles embodied therein. The present embodiment is therefore to be considered in all respects as illustrative and not restrictive, the scope of the invention being indicated by the appended claims rather than by the foregoing description. All changes which come within the meaning and range of equivalency of the claims are therefore to be embraced therein.

I claim:

1. A collapsible table comprising:

(a) a spine having a top component and a vertical support component extending downwardly substantially normal to the top component, (b) a pair of leaves hinged to opposite sides of the spine top component, the leaves being foldable selectably between a substantially co-planar, open position wherein they form a tabletop with the spine top component, and a closed position wherein they extend downwardly parallel to and on opposite sides of the vertical support component to form a container, (c) two pairs of scissor-type, crossed legs, and pivot means pivotally connecting the legs of each pair intermediate their ends, and (d) collapsible mounting means including slide and guide means pivotally and slidably interconnecting the leg pairs and the vertical support component of the spine, the mounting means further including first pivotally mounted link pairs pivotally interconnecting the upper ends of the legs and the vertical support component of the spine, centrally of said support component, and second pivotally mounted link pairs pivotally interconnecting the upper ends of the legs and the leaves, centrally of the leaves, for moving the legs and mounting means between an extended position laterally outward of opposite sides of the vertical support component for supporting the leaves in open position, and a collapsed position substantially aligned with the vertical support component and contained within the outer periphery of the folded leaves.

2. The collapsible table of claim 1 wherein the leaves have inwardly extending peripheral skirts, the leaves simulating the covers of a book and the peripheral skirts simulating the body of the book.

3. The collapsible table of claim 1 wherein the legs include extension segments and latch means for releasably latching the extension segments in their extended position.

4. The collapsible table of claim 1 wherein the slide means is mounted on the legs and the guide means is mounted on the support component.

* * * * *